United States Patent [19]

Van Iperen et al.

[11] Patent Number: 4,923,077

[45] Date of Patent: May 8, 1990

[54] MODULAR HEAT SINK PACKAGE

[75] Inventors: Willem H. P. Van Iperen, Westfield; Edmund B. Wilson, III, Randolph; Robert S. Golabek, Jr., Towaco, all of N.J.

[73] Assignee: PyMaH Corporation, Fairfield, N.J.

[21] Appl. No.: 311,073

[22] Filed: Feb. 14, 1989

[51] Int. Cl.[5] ..... B65D 81/18

[52] U.S. Cl. ..... 220/3.1; 62/372; 62/457.7; 220/412

[58] Field of Search ..... 62/60, 62, 238.1, 238.3, 62/271, 322, 371, 372, 448, 449, 457.1, 457.7, 457.9, 465, 530; 220/3.1, 410, 411, 412, 415, 426, 428, 444

[56] References Cited

U.S. PATENT DOCUMENTS

| | | | |
|---|---|---|---|
| 780,352 | 1/1905 | Kafka . | |
| 2,087,966 | 7/1937 | Clark | 62/457.1 |
| 2,315,425 | 3/1943 | Hill et al. . | |
| 2,543,524 | 2/1951 | De Oliveira | 62/530 |
| 2,602,302 | 7/1952 | Poux | 62/530 |
| 2,677,243 | 5/1954 | Telkes . | |
| 2,677,664 | 5/1954 | Telkes . | |
| 2,808,494 | 10/1957 | Telkes . | |
| 2,856,506 | 10/1958 | Telkes . | |
| 2,989,856 | 6/1961 | Telkes . | |
| 3,236,206 | 2/1966 | Willinger . | |
| 3,255,607 | 6/1966 | Bair et al. | 62/530 |
| 3,262,283 | 7/1966 | Taylor | 62/372 |
| 3,463,161 | 8/1969 | Andrassy . | |
| 3,889,743 | 6/1975 | Presnick | 206/522 |
| 3,986,969 | 10/1976 | Telkes . | |
| 4,003,426 | 1/1977 | Best et al. . | |
| 4,152,899 | 5/1979 | Herrick . | |
| 4,187,189 | 2/1980 | Telkes . | |
| 4,237,023 | 12/1980 | Johnson et al. . | |
| 4,250,866 | 2/1981 | Telkes . | |
| 4,287,250 | 9/1981 | Rudy | 206/522 |
| 4,319,629 | 3/1982 | Hotta | 62/457.7 |
| 4,425,998 | 1/1984 | Hof et al. | 206/443 |
| 4,580,412 | 4/1986 | Wells | 62/530 |

OTHER PUBLICATIONS

*Solubilities of Inorganic and Metal Organic Compounds*, by A. Seidell and W. F. Linke, American ChemicalSociety, Washington, D.C. 1965.

"Thermochemistry of Salt Hydrates", N.T.I.S. Report P. B. 227, 966, (1973), on pp. 71–79.

*Primary Examiner*—Jimmy G. Foster

*Attorney, Agent, or Firm*—Scully, Scott, Murphy & Presser

[57] ABSTRACT

There are disclosed improved modular heat sinks for use in packages for protecting thermolabile goods, having a thermosensitive temperature, from high ambient shipping temperatures in excess of the thermosensitive temperatures. One of the modular heat sinks is adapted to be configured to a variety of box sizes and may be used in either of two configurations, flat or folded. The dimensions of the heat sink and the fold line are correlated to a plurality of box sizes to enable the use of a single size heat sink in a plurality of carton sizes, and for a plurality of degree day temperature protection requirements. A second heat sink having a recessed wall defined therein for protecting a thermosensitive area of the thermosensitive goods is also disclosed. This second heat sink may be combined with the foldable modular heat sink for certain boxes of said plurality of boxes. The heat sinks include a salt hydrate, a hydrophilic suspension agent and from 1% to 10% of the same salt dispersed throughout said salt hydrate. In some of the preferred embodiments of the invention, the heat sinks are held in place by foamed in place insulation, which also surrounds the thermolabile goods and the heat sinks.

31 Claims, 9 Drawing Sheets

"500 C" SHIPPER 1/2 SIZE
(6"X6"X6")

"500A" SHIPPER 1/2 SIZE
(9"X9"X9 1/4")

"500B" SHIPPER 1/2 SIZE
(9"X9"X9 1/4")

MODULAR HEAT SINK PACKAGE

FIELD OF THE INVENTION

The present invention relates to an improved heat sink package for protecting thermolabile goods from degradation if the goods happened to be subjected to high temperatures.

REFERENCES TO RELATED APPLICATIONS

The subject matter of the instant invention is related to U.S. Ser. No. 07/297,879, entitled Heat Sink Protection Packaging for Thermolabile Goods filed on Jan. 16, 1989 and is related in part to U.S. Pat. No. 4,425,998, which issued on June 14, 1984 to the assignee of the present invention.

BACKGROUND OF THE INVENTION

1. Field of the Invention

This invention relates to the packaging and protection of temperature-sensitive goods with insulation and heat sink compounds during shipment thereof.

2. Description of the Prior Art, and Other Information

Many items of commerce are subject to degradation or destruction by excessively high temperatures, e.g., single-use clinical thermometers, irreversible temperature indicators, food, and enzymes, antigens, antibodies, or protein substances used in immunoassays or agglutination tests, and other biological or organic substances such as vaccines, sera, etc. Exposure of clinical thermometers for example, to temperatures above 96° F. will cause them to "fire", i.e., to record the exposed temperature and become unusable for clinical temperature measurement. Products such as clinical thermometers are presently shielded from the adverse effects of high shipping and storage temperatures through heavily insulated shipping cartons containing a "salt foam" formed with sodium sulfate decahydrate as a heat sink material.

U.S. Pat. No. 4,425,998 discloses a shell within a shell construction, wherein a 1" to 2" foam insulating shell surrounds and protects an inner shell of "salt foam" having a relatively high latent heat of fusion. The "salt foam" was prepared by melting a compound of sodium sulfate, absorbing the solution into an open cell foam cell as phenol-formaldehyde, containing the solution and foam within a polyethylene bag and cooling the solution to form sodium. sulfate decahydrate, also known as Glauber's salt. By providing enough insulation to provide a rate of heat transfer through the insulation that is lower than the rate of heat absorption by the compound, a synergistic effect was obtained which significantly extended the period of time in which the thermolabile goods were protected within the carton. While this construction was effective for a single cycle, upon melting and resolidifying, part of the sodium sulfate precipitated out of solution as a particulate sediment, leaving a dilute solution above, which never completely resolidified. In addition, because of the concentrations involved, the solution would partially resolidify as a mixture of sodium sulfate solution and sodium sulfate decahydrate, with multiple incongruent melting points, which adversely effected the performance of the salt foam.

U.S. Pat. No. 4,237,023 to Johnson, et al. discloses an Aqueous Heat Storage Composition Containing Fumed Silicon Dioxide and Having Prolonged Heat-Storage Efficiencies. One of the phase change salts disclosed by this patent is sodium sulfate decahydrate.

U.S. Pat. Nos. 4,187,189; 3,986,969; 2,989,856 and 2,677,664 all issued to Maria Telkes disclose a variety of sodium sulfate decahydrate compositions, one of which, disclosed in U.S. Pat. No. 3,986,969 uses a nucleating agent such as borax and a thixotropic agent such as hydrous magnesium aluminum silicate (attapulgus clay) to form a gel like suspension having a heat of fusion of more than 50 BTUs per pound (28 cal/gm).

"Solubilities of Inorganic and Metal Organic Compounds" by A. Seidell and W. F. Linke, American Chemical Society, Washington, D.C., 1965 compiles a number of phase diagrams of salt hydrates and other systems from which high latent heat of fusion materials may be selected. Some of these are also set forth in "Thermochemistry of Salt Hydrates", N.T.I.S. Report P.B. 227966 (1973) on pages 71–79.

OBJECTS OF THE INVENTION

It is an object of the present invention to provide an improved modular heat sink package for protecting thermolabile goods having enhanced configuration characteristics and superior performance characteristics.

It is another object of the present invention to provide an improved modular heat sink that may be used in a plurality of box sizes in either a flat or folded configuration.

It is another object of the present invention to provide an improved modular heat sink having a recessed well therein for recessing a thermosensitive portion of the thermolabile goods.

It is another object of the present invention to position and hold a configurable heat sink in its desired location with foamed in place insulation.

It is another object of the present invention to provide an improved heat sink composition for protecting thermolabile goods that permits ready shipping of the goods to be protected because the composition remains in non-segregating form at shipping temperatures, even though exposed to repetitive cycles of 100° F. to 120° F. temperature that may be experienced in a normal summer shipping environment.

It is another object of the present invention to provide an improved method for protecting thermolabile goods wherein protection is provided by the ability of the chemical to absorb heat at a rate sufficient to protect the goods when the temperature of the environment exceeds the melting point of the chemical.

It is another object of the present invention to provide a method for making the composition that drives a mixture of salt and water into its maximum hydrate configuration to thereby consistently obtain a composition with isothermal melting characteristic.

SUMMARY OF THE INVENTION

The present invention is directed to a modular heat sink and a plurality of packages for utilizing the heat sink for protecting thermolabile goods from degradation or destruction by excessively high temperatures, by surrounding the goods with the heat sink having a melting point slightly less than the thermosensitive temperature of the goods and the capacity to absorb heat at a rate sufficient to protect the goods when the temperature of the environment exceeds the melting point of a compound. By "thermosensitive temperature", we mean the temperature at which a given property or characteristic of a substance to be protected begins to be affected in a discontinuous or abrupt or predetermined manner as a function of temperature, e.g., it may be a melting point, a freezing point, a temperature at which the property or characteristic is affected by relatively short exposure (almost instantaneously for thermometers) to degradation or deterioration. By "slightly less" we mean a temperature commencing from about 1° C. to about 20° C. below the thermosensitive temperature, and in special circumstances even many degrees below the thermosensitive temperature, as will be described, infra.

Preferably, the melting point of the composition protecting the thermolabile goods is from about 3° C. to about 10° C. and most preferably, from about 3° C. to about 5° C. less than the thermosensitive temperature of the thermolabile goods being protected.

The present invention provides an improved hydrate composition that remains in solid form, and in one portion of the salt-water phase diagrams, rather than shifting its composition in response to temperature cycles and partial melting.

By utilizing a hydrophilic bonding agent to maintain excess anhydrous salt equally dispersed within a saturated solution, a pre-selected hydrate will always be formed when the solution is cooled. This composition is particularly useful in the present invention when used to protect goods that are shipped under ambient atmospheric condition, with repetitive cycles of heating and cooling.

DETAILED DESCRIPTION OF THE PREFERRED EMBODIMENTS

Figure 1:
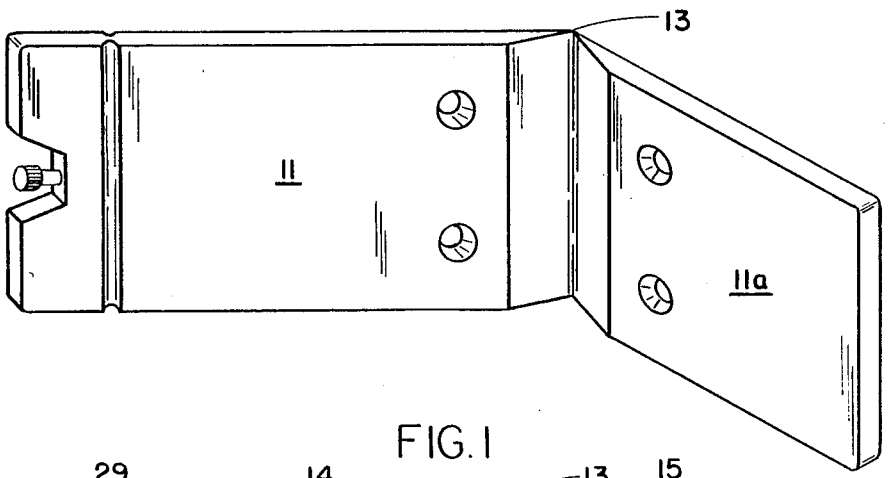
FIG. 1 is an isometric view of the foldable modular heat sink of the present invention.

It has been discovered that the cost of protective packaging of heat labile goods can be significantly reduced by using modular heat sinks having an improved salt hydrate composition. Sodium sulfate decahydrate, e.g. Glauber's salt, acts as a refrigerant as follows: the melting point of Glauber's salt is 32.38° C. A clinical thermometer such as described in U.S. Pat. Nos. 4,189,942, 4,232,532 and 4,345,470 begins to indicate temperature at 35.5° C. When the clinical thermometers are packaged with a heat sink of the improved composition utilizing Glauber's salt and exposed to high temperatures, for example 50° C., the temperature of the heat sink rises until it reaches 32.38° C. At that temperature, the Glauber's salt begins to melt and absorb heat (energy) at a capacity of about 54 cal/gram (17 kcal/mole) of the sodium sulfate decahydrate. The package will remain at about 32° C. until the salt hydrate has been melted. Typically the prior art package as illustrated in U.S. Pat. No. 4,425,998 included a fiber board or corrugated box on the outside, an intermediate layer of insulating foam, and an interior layer of "salt foam".

The rate of heat conduction through any material including insulation, is directly proportional to the difference in temperature on either side of the material or insulation. By selecting a salt hydrate with a melting point near the temperature to be protected, the "heat sink" protection of the hydrate is reserved until ambient temperature actually exceeds the melting temperature, and the rate of heat flow is minimized since the temperature differential is minimized. When ice is used as refrigerant in an exposure to 100° F., the difference in temperature is 68° F. With Glauber's salt, however, the difference in temperature is only 10.4° F. (100° F.–89.6° F.). Thus, the rate of heat flow with Glauber's salt is less than 1/6 the rate of heat flow with ice as refrigerant. The result of the differences in temperature and heat of fusion between Glauber's salt and ice is that one pound of Glauber's salt will preserve the goods in the package as well as 4.5 pounds of ice during exposure to 100° F. Therefore, if a compound such as Glauber's salt is employed alone, it is employed in such a calculable effective amount to protect the contents, i.e., in an amount effective as to absorb a given amount of heat in a given environment having an ambient temperature sufficient to protect the contents for a predetermined amount of time.

For the application of preserving single-use thermometers, sodium sulfate decahydrate, sodium carbonate decahydrate or calcium chloride hexahydrate are will suited. Other thermally labile goods or applications may require alternate salts or compounds, some of which are listed below:

| Hydrates | Melting Point (°C.) | Heat of Fusion (kcal/mole) |
|---|---|---|
| $Ca(NO_3)_2 4H_2O$ | 47 | 8.13 |
| $Na_2HPO_4 12H_2O$ | 35.5 | 23.9 |
| $Na_2S_2O_3 5H_2O$ | 48 | 5.6 |
| $Zn(NO_3)_2 4H_2O$ | 45.5 | 9 |
| $Fe(NO_3)_2 6H_2O$ | 60 | 8.5 |

As previously mentioned, the salt hydrate should be selected as one having a melting point about 3° C. to about 5° C. below the labile temperature, or the thermosensitive temperature of the goods. The amount of refrigerant is dependent upon the thickness of insulation and surface area/volume ratio of the package, the amount of time and the temperature for which the goods need protection, as will hereinafter be described in greater detail.

While the use of the above hydrate salts has many advantages, there are some minor problems. First, unless cast into a solid block, the salt hydrates are generally formless powders which can be difficult to handle. Further, upon melting, they form liquids which are free to flow into new geometrics within their container, if flexible and thereafter separate or stratify.

Figure 4:
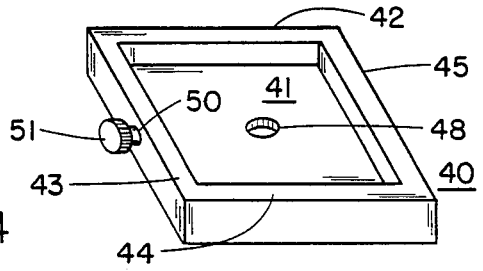
FIG. 4 is a diagrammatic view of an alternate embodiment of the modular heat sink of the present invention illustrating a recessed cavity defined therewithin.

In the present invention, the salt hydrate is poured while in suspension-slurry form into a plastic bottle. The plastic bottle is made by blow molding, and is preferably formed from high density polyethylene plastic, although any plastic which remains flexible enough for folding would be suitable, including medium density polyethylene, low density polyethylene and polypropylene. As illustrated in FIGS. 1 and 4, the modular heat sinks of the present invention include a first foldable heat sink as illustrated in FIG. 1, and a second recessed cavity heat sink as illustrated in FIG. 4.

Figure 2:
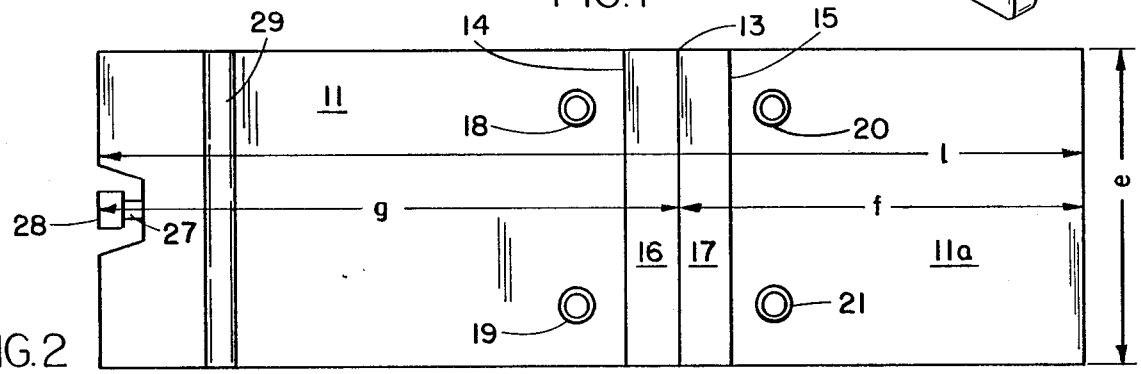
FIG. 2 is a plan view illustrating the elongated rectangular configuration of the foldable modular heat sink of the present invention.
Figure 3:
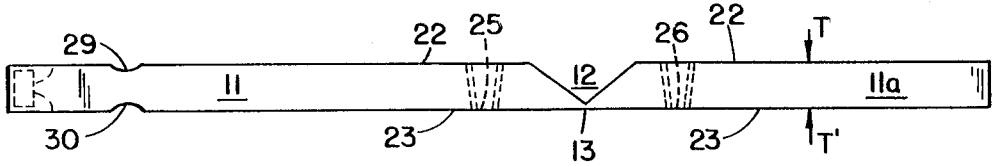
FIG. 3 is a side view of the foldable modular heat sink illustrated in FIGS. 1 and 2.

As illustrated in FIGS. 1, 2 and 3 in which, like reference numerals refer to identical parts, the foldable modular heat sink includes plastic bottle 11 having an elongated rectangular cross section and a thickness indicated by T–T' in FIG. 3 of ⅜" to 1". In the preferred embodiment of the present invention, a thickness of ⅜" was selected, together with a l of 15¼" and a w of 5¼". A vee shaped notch 12, (best illustrated in FIG. 3) is formed on one planar side of the heat sink to enable the heat sink to be folded about fold line 13 as illustrated in FIG. 1, as will be described with respect to FIGS. 10 and 11. The angle between fold line 13, and the planar wall lines 14, 15 is initially set to greater than 90 degrees to accommodate minor bulging of the planar surfaces 16, 17 during the filling and cooling operations. The foldable heat sink includes spacing means 18–21 which are formed from the upper wall 22 and which extend downwardly or inwardly to the opposing wall 23. Optionally, as will be further described with respect to FIGS. 4–6, the spacing means 18–21 may also be heat sealed at their centers 25, 26 to the lower or rearward wall 23 illustrated in FIGS. 2 and 3. As noted in FIGS. 1–3, the spacing means define a wall 22 are of conical section, which is selected to ease the draw tension on the plastic during the blow molding operation. The plastic bottle 11 is further equipped with an inlet spout 27 which is sealed by cap 28 after the bottle is filled with the salt hydrate solution-slurry. A pair of grooves 29, 30 are formed adjacent to filling spout 27 to assist in holding and registering the plastic bottle during the filling operation.

During the pouring and filling operation, the inlet spout 27 is oriented vertically upwards, with the registration grooves 29 and 30 horizontally disposed below. As will be hereinafter explained in detail, the salt hydrate solution-slurry is prepared and mixed at elevated temperatures of 120°–150° F. and preferably at 145° F. If the HDPE bottles are molded with a wall thickness of 0.01", the weight and temperature of the salt hydrate may cause mild distention or bowing of the side walls 22, 23 and 16, 17, particularly as the salt hydrate migrates past the vee notch 12 to the lower section 11*a* of the foldable salt bottle.

To assist in returning the salt bottles to their desired configuration, the bottles are stacked horizontally for cooling and solidification on plates with their vee notches oriented upwardly. Intermediate plates, each of which has a downwardly projecting and complimentary vee-shaped projection engages the notch 12 along walls 16, 17 to drive them downwardly against lower wall 23 and remove any salt hydrate that may be trapped at the apex of the vee notch. Each of the plates is weighted by the weight of the additional salt bottles and plates stacked thereabove. After cooling and solidification, the bottles are then ready for use in either the flat or folded configuration as will be hereinafter described.

Figure 5:
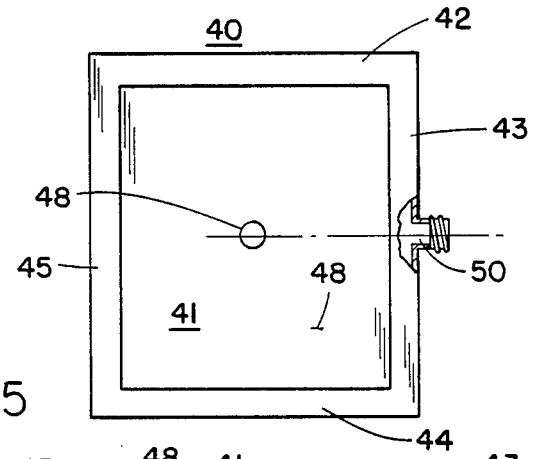
FIG. 5 is a plan view of the alternate embodiment illustrated in FIG. 4.
Figure 6:
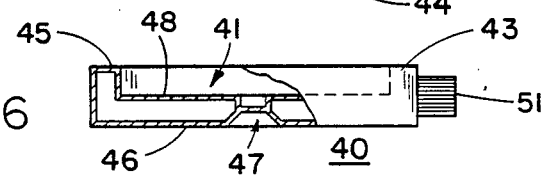
FIG. 6 is a side view of the embodiment illustrated in FIGS. 4 and 5.

A second, recessed cavity modular heat sink 40 is disclosed in FIG. 4–6. As illustrated therein, the heat sink 40 is rectangular, and in the preferred embodiment, a substantially square configuration having a width that is substantially the same as the width of the foldable modular heat sink. Both the configuration and the width w are selected to enable the recessed cavity heat sink to be used with a variety of different size boxes, with or without the modular heat sink illustrated in FIGS. 1–3. The recessed cavity heat sink has a recessed cavity 41 defined in the outer wall 48 of the plastic bottle which creates four upwardly extending parapet walls 42–45. The bottom wall 46 has an upwardly extending projection 47 which defines a spacing means between bottom wall 46, and the recessed wall 41. As illustrated at 48 in FIGS. 4 and 5, the cavity wall 41 is joined to the spacing means 47 by heat sealing. The recessed cavity bottle also defines an inlet spout 50 which is closed by a cap means 51 after the bottle has been filled with a salt hydrate solution-slurry. While the configuration of the modular heat sinks illustrated in FIGS. 1 and 4 are complementary, and adapted to be used with a plurality of box sizes, they are also defined by the dimensions and configuration of the product box in which they are intended to be used. Thus, while a square configuration has been illustrated in FIG. 4, it should be noted that the principles of the invention would apply if the package containing the thermolabile products was rectangular or even circular, wherein the recessed well would become rectangular or circular to match.

The use of the modular heat sinks illustrated in FIGS. 1 and 4 will be hereinafter described with a variety of carton sizes, as illustrated in FIGS. 7–12 for the packaging of Tempa-Dot® single use sterile thermometers manufactured by PyMaH Corp., the assignee of the present invention, located in Somerville, N.J. These single use thermometers are thermolabile inasmuch as they begin to "fire" at 96.0° F., and such firing is irreversible. For shipment thereof, the heads of the thermometers must therefore be kept at a temperature below 95° F.

Figure 7:
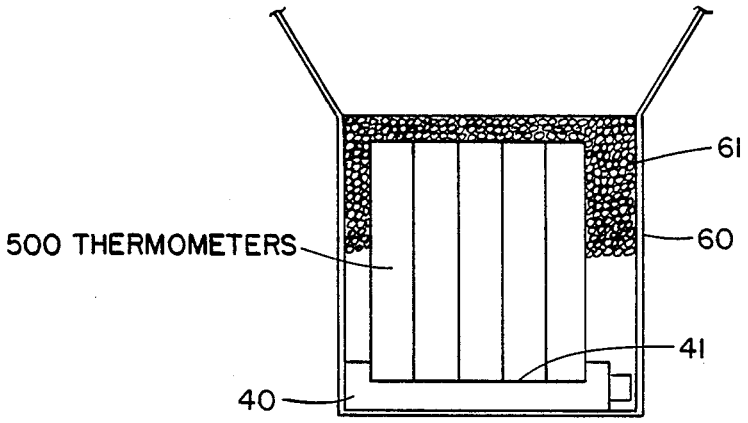
FIG. 7 is a diagrammatic cross section of a package utilizing a modular heat sink having a protective well to protect thermolabile goods, wherein the package is intended for minimal degree day protection.
Figure 9:
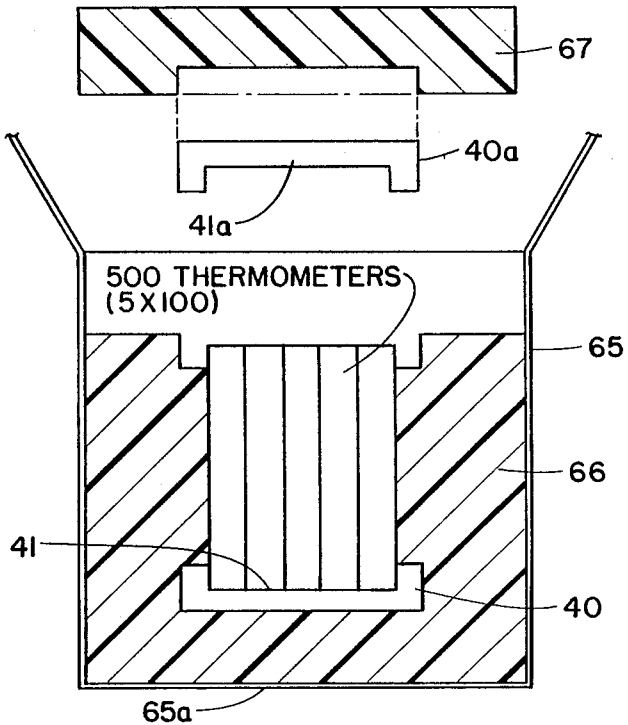
FIG. 9 is a diagrammatic cross section of a package utilizing the modular heat sinks of the present invention particularly adapted for maximum degree day protection.
Figure 8:
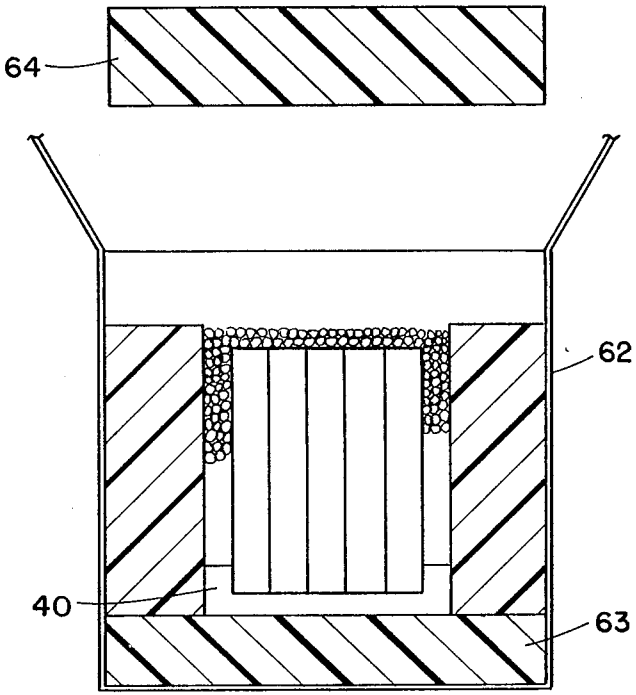
FIG. 8 is a diagrammatic cross section of a package using modular heat sink of the present invention particularly adapted for moderate degree day protection.

FIGS. 7–9 represent three separate levels of protection for different average ambient temperatures. The shipping configuration illustrated in FIG. 7 is used for winter shipments, the configuration illustrated in FIG. 8 is used for spring and fall shipments, and the configuration illustrated in FIG. 9 is used for summer shipments wherein it is highly probably that degree days in excess of 95° F. will be encountered. It should be noted in this regard that ambient temperature, as defined herein, includes a truck body, or car trunk, whose temperature within may be well in excess of the atmospheric ambient temperature if the truck body or automobile is parked in direct sunlight.

As illustrated in FIG. 7, five boxes having 100 thermometers each are packed heads down with the thermosensitive portion, i.e. the heads of the thermometers, enclosed by the protective well defined by salt bottle 40. The remainder of the thermolabile goods are protected with bubble pack or other light duty shipping insulation. The modular heat sink 40, the thermolabile goods, and the bubble pack insulation 61, are further enclosed in an outer shipping container 60 which may be formed of corrugated cardboard, paper, plastic, wood or the like. In the preferred embodiment, corrugated cardboard is used. The configuration illustrated in FIG. 7 is used in the winter time when it is unlikely that ambient atmospheric temperatures will exceed 85° F. to 90° F.

In the embodiment illustrated in FIG. 8, an outer container 62, formed of corrugated cardboard, is lined with rigid polystyrene foam insulation 63 and the recessed cavity modular heat sink 40 is inserted therein. The thermolabile goods, again being five boxes of 100 thermometers each, are inserted heads down into the cavity defined by the modular heat sink 40, and the space between the polystyrene foam insulation and the thermolabile goods filled with bubble pack. The package is closed with an additional layer of polystyrene 64 and the package is taped shut. This package is used when the anticipated degree days along the destination route are from 90° F. to 95° F. It should be noted here that the polystyrene foam is approximately 1½" thick, and the exterior carton is approximately 9"×9". This leaves a 6"×6" cavity within the polystyrene foam which is essentially the same size as the 6"×6" corrugated cardboard box 60 used in FIG. 7. The modular heat sink 40, measured from the outside of the cap to the bottom of the salt bottle is approximately 6" across.

The shipping carton illustrated in FIG. 9 is formed in a somewhat different manner than that illustrated with respect to FIG. 7 and 8. A male molding form representing the approximate space of the foam cover and the thermolabile goods is positioned in a foaming jig. The modular heat sink 40 is then positioned atop the male mold, and the shipping container 65 inverted thereabove with the bottom most portion **65*a* open. The box insulation 66** is then foamed in place with polyurethane foam. In a preferred embodiment, the foam is Instapack-40F polyurethane, as sold by Sealed Air Corporation of Danbury, Conn.

It has a K factor of 0.38 and is substantially lighter and less expensive than the foam utilized in prior U.S. Pat. No. 4,425,998, which was Instapack-200, a polyurethane foam having a K factor of 0.15. After foaming, the bottom **65*a* of the box 65 is closed and taped shut, and the box is removed from the male mold to define a recessed cavity for the thermolabile goods. The goods are inserted, a second modular heat sink 40*a* is positioned over the goods with the recessed cavities 41 and 41*a* facing one another to define a thermally protected zone there between for protecting the thermolabile goods. The foam cover 67** is added, and the box sealed and taped shut.

Figure 10:
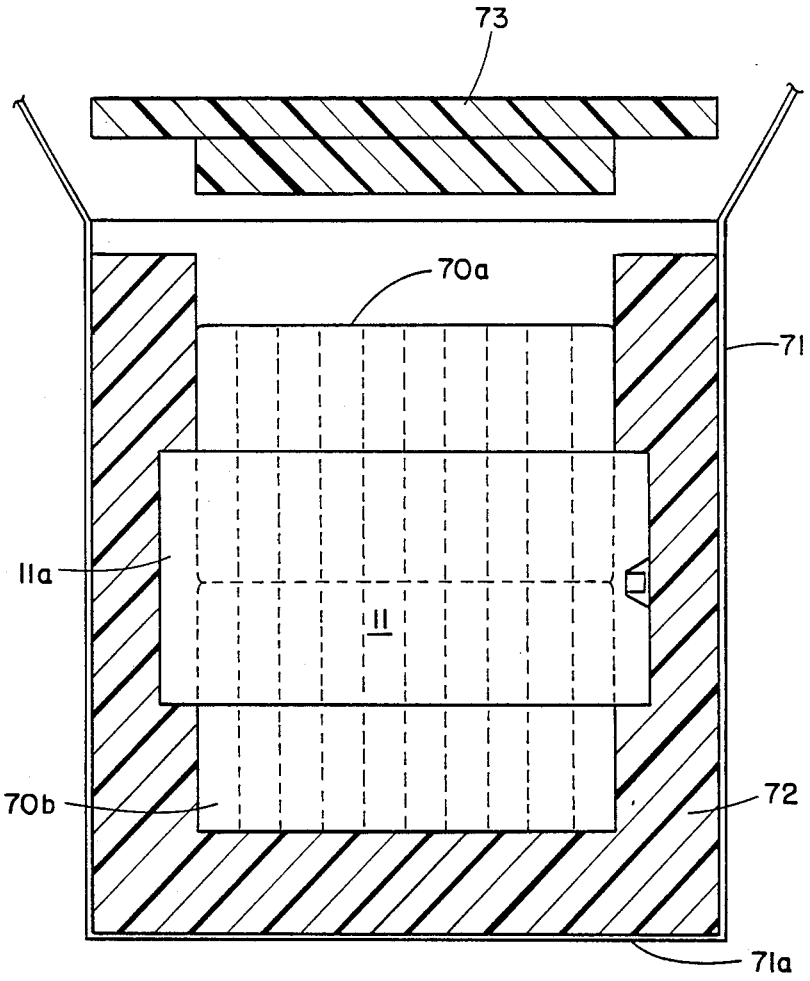
FIG. 10 is a diagrammatic cross section of a preferred embodiment of the present invention illustrating a protective band formed from the modular heat sinks and secured by foamed-in-place insulation.
Figure 11:
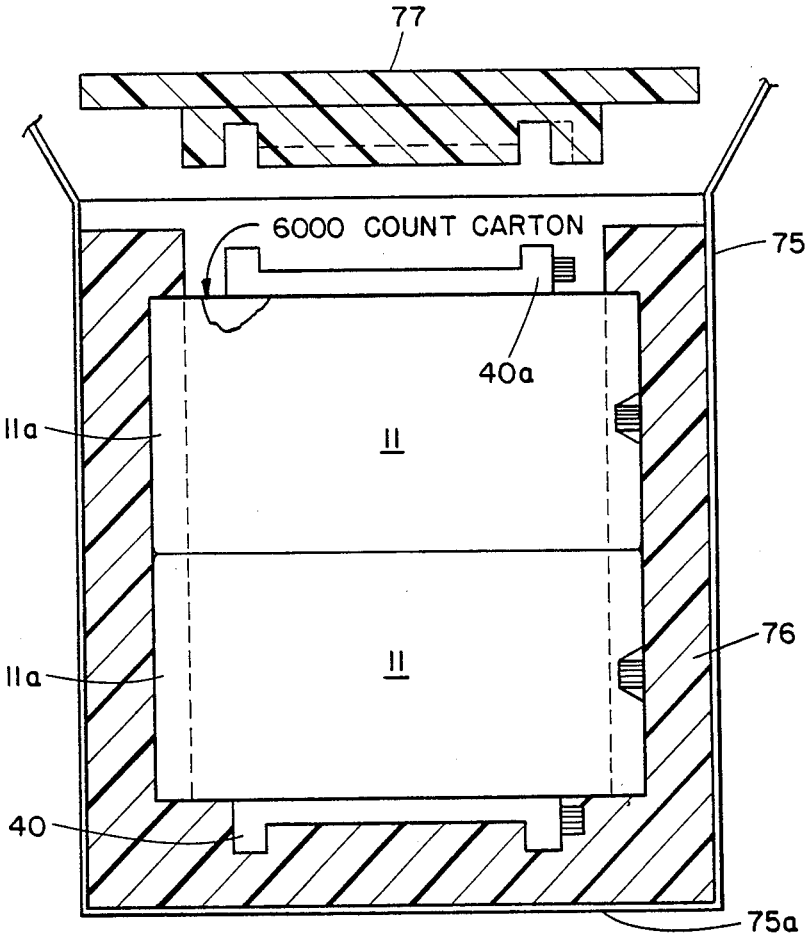
FIG. 11 is a diagrammatic cross section of a larger shipping carton which utilizes both embodiments of the modular heat sinks of the present invention.
Figure 12:
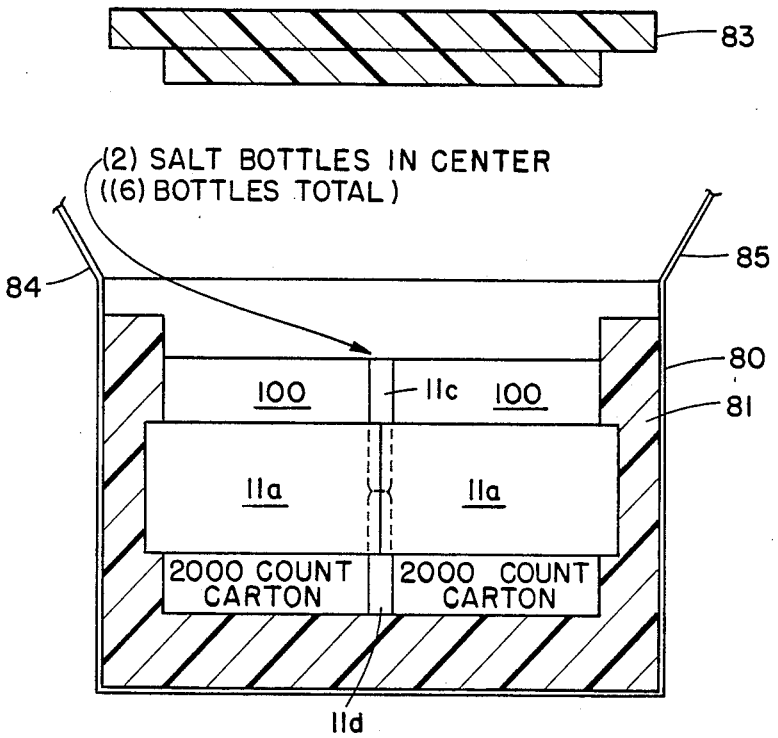
FIG. 12 is a diagrammatic cross section of still another size and configuration of shipping cartons utilizing the modular heat sinks of the present invention in both flat and folded configurations.

In the embodiments illustrated in FIGS. 10–12, the foldable modular heat sink configuration is utilized, with the embodiment illustrated in FIG. 11 utilizing both forms of the modular heat sink.

As illustrated in FIG. 10, a shipping package is provided for the shipment of a single carton of 2000 Tempa-Dot® thermometers. As packaged in this carton, the thermometers are "heads in" in two separate layers. The bottom layer indicated at **70*a* is packaged with the heads pointed upwardly, and the top layer indicated at 70*b* is packaged with the heads pointed downwardly. This means that the thermosensitive portion of the thermometers, i.e. the heads, are packaged behind and within a band of the modular heat sink bottles 11. When package illustrated in FIG. 10 is created, a male form is used which approximates the size of the 2000 count carton and the size of the foam cover. Two of the modular heat sinks are folded about their fold lines 13 and mounted end to end to form a band which extends around the inner periphery of the package. The band thus formed is rectangular, having a length equivalent to dimension g, and a width equivalent to dimension f, both illustrated in FIG. 2. In forming the package, the modular heat sinks are strapped into position about the male mold with tape, and the carton 71 is slipped upside down over the male mold and the insulation 72 is then foamed-in-place through the bottom of the box 71*a*, which has not yet been taped. After insertion of the foam, the box bottom 71*a* is taped, and the box is removed from the mold with the foamed in place insulation 72 securing the band of modular heat sink bottles 11 in the position illustrated in FIG. 10. The carton of thermometers is then loaded in the box, the foam cover 73** inserted, and the package closed and taped.

FIG. 11 illustrates another insulated heat sink protective carton designed to solve a different packaging problem. The 6000 count shipping package used by PyMaH Corporation contains randomly oriented thermometers. The 2000 count carton contained individually packaged and sub-packaged groups of thermometers. Both cartons are approximately the same size. In the 6000 count carton, the thermometer heads are not neatly oriented in any particular direction within the carton. In forming this container, a male mold corresponding to the size of the carton and the foam cover is used and four modular heat sinks 11 are strapped to the exterior of the male mold, to form a pair of parallel bands adjacent one another. A recessed cavity salt bottle 40 is placed on top of the mold before the foaming operation. The carton 75 is then inverted over the male mold and the insulation 76 is then foamed-in-place between the strapped and folded modular heat sinks 11 and the corrugated cardboard package 75. After foaming, the bottom of the box **75*a* is closed and taped, and the container is removed from the mold. The carton may then be loaded, and after loading, a second salt bottle 40*a* added on the other side of the band. The foam cover 77** is slipped into place, and the top of the carton is closed and taped. There are four folded modular heat sinks in the carton illustrated in FIG. 11, and two of the recessed cavity heat sinks. Two of the modular heat sinks are folded and joined end to end to form a first band, and a second pair of modular heat sinks are folded and joined end to end to form a second parallel band, with the openings at either end of the parallel bands nearly closed by the recessed cavity modular heat sinks.

FIG. 12 illustrates a still larger carton intended for the shipment of 8000 thermometers, or 4 cartons of the type shipped singly in the package illustrated in FIG. 10.

As illustrated in FIG. 12, four foldable heat sinks are folded and taped into a single continuous band with their portions 11*a* joining as illustrated in FIG. 12. This continuous band, formed from four separate heat sinks is secured in place within carton 80 by virtue of foamed in place insulation 81. A pair of salt bottles, in their unfolded state are inserted between the thermometer cartons 100 as illustrated at 11*c* and 11*d*. The center heat sinks cover the temperature gradient that exists in the middle of carton 80. Again, with the cartons utilized with the package illustrated in FIG. 12, the thermometers are packaged heads in, in two layers, so that all of the heads, or the thermosensitive portions of the thermometers are located within the continuous band of modular heat sinks 11*a*. A foam cover 82 is added after the cartons 100 have been packed, and the flaps 84, 85 are taped in place before shipment.

Figure 13:
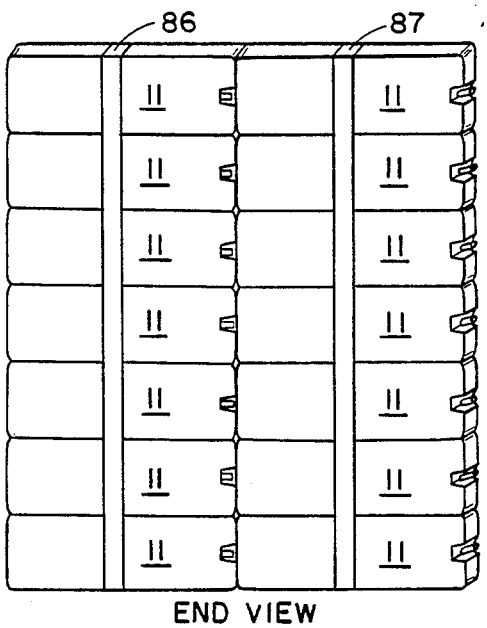
FIG. 13 is a diagrammatic illustration of a planar heat sink formed by "tiling" a plurality of modular heat sinks into a single structure.

FIG. 13 illustrates a tile or tiling application wherein a plurality of modular heat sinks 11 are taped or strapped together by bands 86, 87 in a "tiled" formation to protect one wall of substantially larger "gaylord" package, the package being 51" long, 42" high and 37" wide. The tiled heat sinks formed by the continuous rows of modular heat sinks are then surrounded with sheet insulation, and packaged in a suitable outer container. In the "gaylord" package, a multiplicity of "tiled" formations are used.

Figure 15:
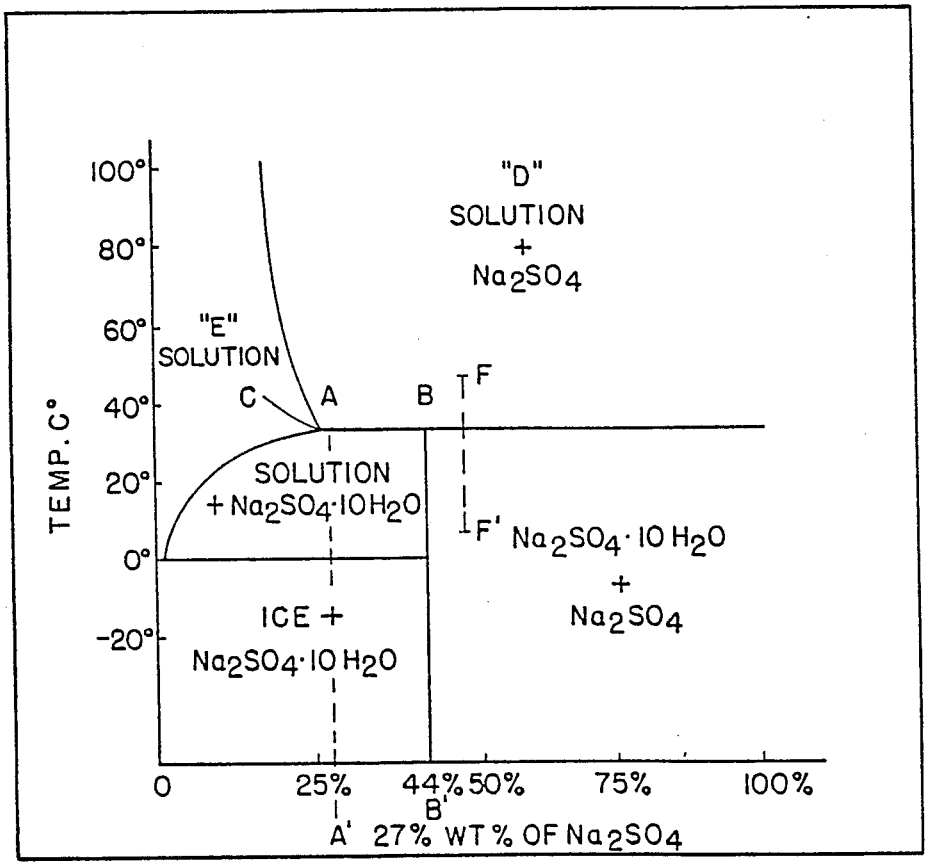
FIG. 15 is a salt-water phase diagram for sodium sulfate.

Each of the modular heat sinks 11, 40 is filled with a hydrate salt composition. This hydrate salt composition is an improvement on the "salt foam" composition described in the prior art U.S. Pat. No. 4,425,998. The composition has been improved by overdriving anhydrous sodium sulfate into the system together with a hydrophylic suspension agent, which forms an improved composition that has a substantially greater latent heat of fusion than the prior art "salt foam," has the ability to reduce stratification upon the repetitive melting and cooling cycles, and has a desirable isothermal melting curve. The improved composition remains as a non-separating hydrate/salt composition until all of the latent heat is exhausted, at which point the entire solid is melted. As illustrated in FIG. 15, the improved composition cycles along axis F'-F when heated and cooled, does not shift to the left as did the "salt foam" composition illustrated in U.S. Pat. No. 4,425,998.

Figure 14:
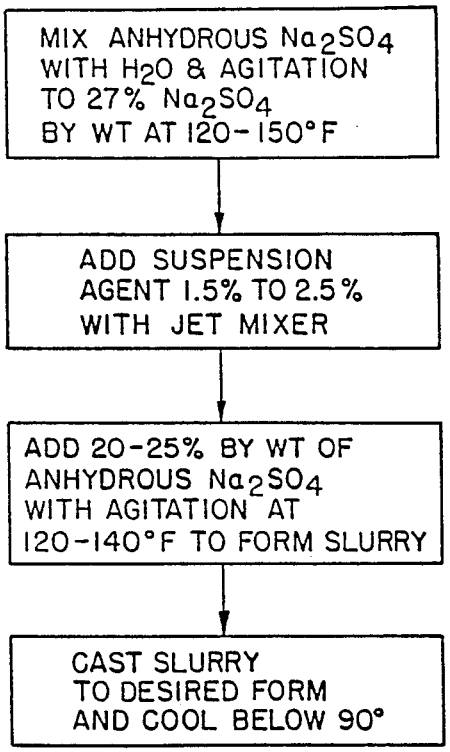
FIG. 14 is a flow chart illustrating one method of preparing the salt hydrate utilized in the present invention.

As illustrated in FIG. 14, and more completely described in copending application U.S. Ser. No. 279,879, entitled "Heat Sink Protective Packaging for Thermolabile Goods," the entire disclosure of which is incorporated herein by references thereto, the improved composition is formed by first mixing 200 lbs of anhydrous sodium sulfate with 60 gallons of water, with agitation, to create an aqueous solution which is approximately 26% by weight, sodium sulfate. The water is preheated to 120° to 150° F., and preferably 145° F. After the saturated solution has been formed, 16 pounds of a hydrophilic suspension agent such as CAB-O-SIL, by Cabot Corporation (fumed silicon dioxide) is then added to the solution with gentle, low shear agitation, such as that imparted by a jet mixer, to achieve a total weight of 1.5 to 2.5% of fumed silicon dioxide in the final composition. After the CAB-O-SIL has been evenly dispersed, an additional 340 lbs., or 20 to 30% by weight of anhydrous sodium sulfate is added with agitation at 120° to 140° F. to sulfate. This slurry may then be cast into any desired form, by weight of sodium and then cooled below 90° F. to form sodium sulfate decahydrate, with evenly dispersed finely divided crystalline anhydrous sodium sulfate particles embedded therein. Nucleation agents are no longer necessary. The resulting composition is a hard white crystalline block of decahydrate salt and sodium sulfate crystals interlinked together by hydrogen bonding with long chain fumed silicon dioxide hydroxyl groups. The improved composition also results in a superior performance, having approximately twice the heat absorption characteristics of the prior art "salt foam." It is estimated that the latent heat of the improved composition is approximately 83 BTU per pound (46 cal/g).

Jaguar C-13 (a guar gum from Stein-Hall) and CAB-O-SIL M-5 (formed silicon dioxide from Cabot Corporation) appear to be the most effective suspension agents, both creating a suspension of castable viscosity at approximately 1.5% by weight. CAB-O-SIL M-5 also offers the advantages of commercial availability, lower cost per pound, and of being able to vary the viscosity of the suspension by altering the amount of CAB-O-SIL added. 1.5% of CAB-O-SIL M-5 created a suspension, 2% created a viscous suspension, 2.5% created a very viscous suspension, and 3% created a plastic suspension, almost a paste. CAB-O-SIL M-5 is fumed silicon dioxide which is surface hydrophilic due to hydroxyl groups attached to some of the silicon atoms and is capable of forming hydrogen bonds with water. It forms a classic thixotropic suspension in water, since the hydrogen bonding is strong enough to create an interconnected network of silicon dioxide and water molecules. When subjected to a shear force, however, such as mixing or pouring, the weak hydrogen bonds are broken, and the suspension may be poured. Similarly, it is believed that the hydrophilic nature of CAB-O-SIL creates the same type of hydrogen bonding with the waters of crystallization that are bonded to the hydrate molecule, with the crystalline lattice hydrate bond being stronger than the hydrogen bond. The network suspends the particulate anhydrous sodium sulfate crystals in an even dispersion until cooling, and in some manner, not fully understood, promotes or enables the formation of the hydrate crystals, since the improved composition with 1 to 10% excess anhydrous salt solidifies readily when cooled into hydrate crystals, without the use of nucleating agents, and does not substantially undercool, a problem frequently noted and addressed in reversible phase systems.

After selection of CAB-O-SIL M-5 as the preferred suspension agent, a number of salt phase systems were tested in addition to the sodium sulfate system. The preferred range for use of calcium chloride was 50–60% by weight of calcium chloride which forms a mixture of calcium chloride hexahydrate and calcium chloride tetrahydrate. These hydrates are formed at temperatures below 86° F., as indicated by published phase diagrams for calcium chloride. Above 86° F., the calcium chloride hexahydrate is disassociated, and only calcium chloride tetrahydrate and solution are found. It should be noted that the use of CAB-O-SIL M-5 with a calcium chloride salt phase system resulted in a satisfactory system, with no substantial undercooling, even without the use of nucleating or precipating agents.

Calcium chloride does not have the same limitation of solubility addressed with respect to the sodium sulfate system. However, above 86° F., some calcium chloride tetrahydrate crystals remain suspended in solution, probably by hydrogen bonding to the CAB-O-SIL.

Sodium carbonate was tested with and without CAB-O-SIL at 39% by weight and 75% by weight solutions. As indicated by published phase diagrams, a 39% by weight system forms a mixture of sodium carbonate decahydrate and sodium carbonate heptahydrate at temperatures below 89.6° F. At temperatures above 89.6° F., the decahydrate is disassociated in solution with the heptahydrate remaining. The heptahydrate releases its waters of hydration at 95.7° F. The sodium carbonate systems without CAB-O-SIL stratified and formed a layer of precipitated anhydrous sodium carbonate. The preferred composition for the sodium carbonate system is from 38–45% by weight of sodium carbonate, approximately 4% by weight of CAB-O-SIL and the remainder water.

The improved composition of the present invention provides a superior performance that enables the use of higher K value (less expensive) foam and smaller quantities of the composition to achieve the same result.

Figure 16:
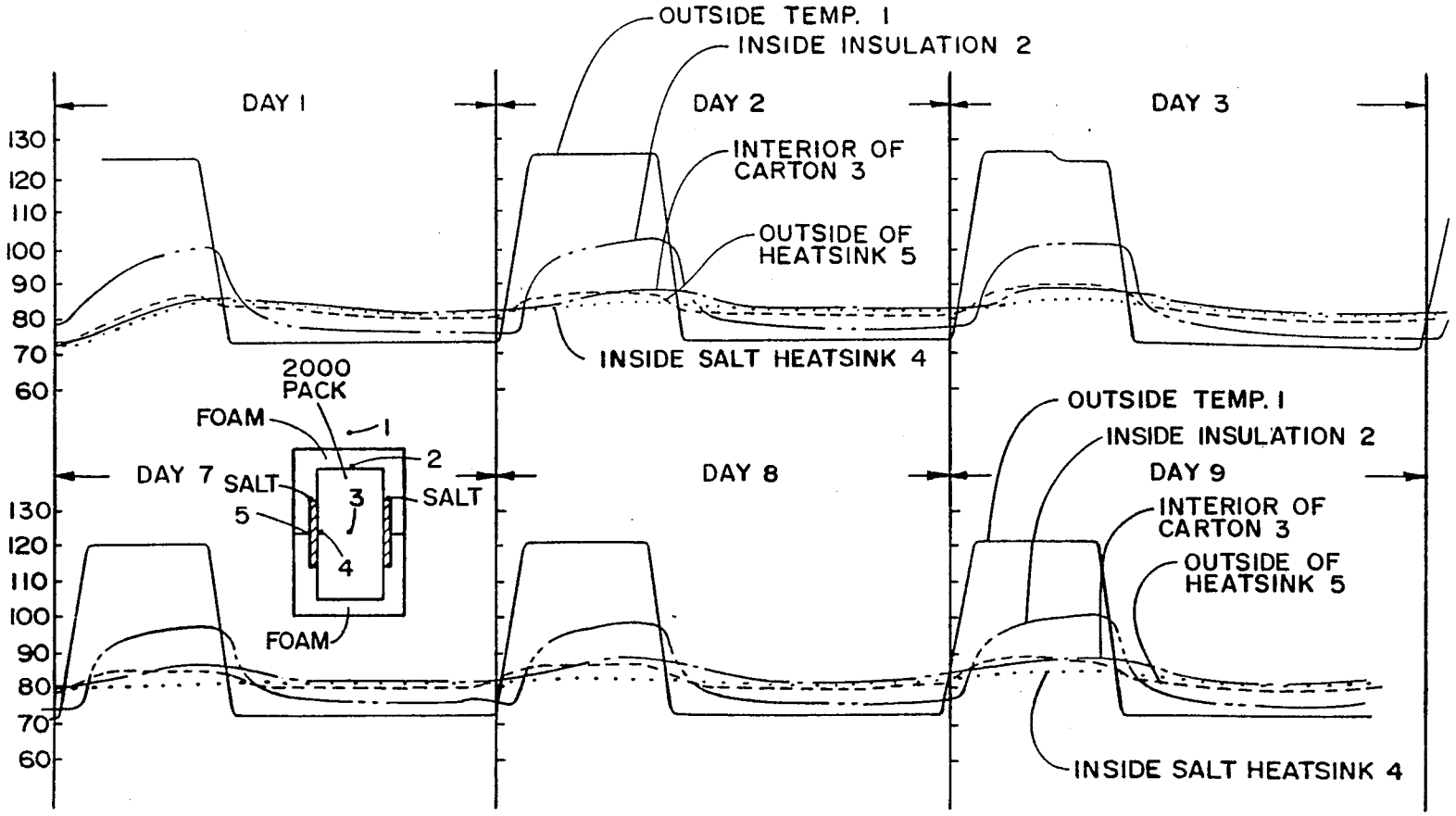
FIG. 16 is a time vs temperature chart prepared during a test of the package configuration illustrated in FIG. 10.

The present invention, as illustrated in FIGS. 9, 10, and 12 provide a band of the improved composition surrounding the critical portion of the thermolabile product, and both are placed within an insulated carton. Even though the insulation has a substantially higher K value, and there is less total sodium sulfate decahydrate within the carton, the improved package provides 50% longer protection than the package described in U.S. Pat. No. 4,425,998. In addition, it is no longer necessary to form a complete "shell within a shell." Further, because the improved sodium sulfate system does not stratify, the improved composition provides significantly longer protection when used in a real world environment. In normal shipping conditions, ambient atmospheric temperatures reach a maximum high at one to three o'clock in the afternoon, with a maximum low just before dawn. FIG. 16 illustrates six days of a nine day test of the package illustrated in FIG. 10. In this cycle test, the package was subjected to an eight hour cycle of 120° F. followed by a 16 hour cycle at 72° F. for a period of nine days, and the temperatures were measured at a variety of points within the carton, as indicated by the legends and tracings depicted in FIG. 16. During the nine days, the temperature within the band enclosed by the salt bottles never exceeded 90° F. The highest temperature recorded in the box, at the internal distance furthest from the improved salt composition, was 97° F.

In other cycle test, wherein the thermometers were subjected to cycles varying from an high of 120° F. to a low of 85° F. during the day, the critical temperature within the band of salt bottles did not exceed 83° F. until the eighth day of the test. Thus when subjected to repeated cycling, as present in a real world shipping environment, the improved composition of the present invention substantially out performed the prior art salt foam system.

With the improved composition of the present invention, one may either (a) increase the K factor of the foam, provided the total insulation has a rate of heat transfer through the insulation which is less than the rate of heat absorption, (b) decrease the insulation thickness or (c) reduce the amount of salt composition within the package; or any combination thereof. In addition to the enhanced performance, the improved stability of the composition extends the service life of the package, when subjected to a heat cycling environment.

What is claimed is:

1. A modular heat sink for protecting thermolabile goods having a thermosensitive temperature from high ambient temperatures in excess of said thermosensitive temperature, said modular heat sink being particularly adapted and configured for use with a plurality of box sizes, said heat sink comprising:

(a) a foldable plastic bottle having an elongated rectangular planar cross section and at least first and second walls;

(b) said bottle being filled with a salt hydrate composition which will absorb heat from said high ambient temperatures and thereby protect said thermolabile goods, said composition being solid at said thermosensitive temperature;

(c) a V shaped notch formed on one side of the bottle in said first wall for enabling said bottle to be folded about said notch when said composition is solid to match the internal dimensions of selected boxes of said plurality of boxes said notch being greater than 90%;

(d) the rectangular dimensions and the placement of the notch being selected so that one of more panels may be formed with one or more bottles, and matched to one or more interior dimensions defined by said plurality of box sizes.

2. A modular heat sink as claimed in claim 1 wherein a pair of bottles are folded about their respective notches and joined end to end to form a protective band of heat sink material which surrounds a thermosensitive portion of said thermolabile goods.

3. A modular heat sink for protecting thermolabile goods having a thermosensitive temperature from high ambient temperatures in excess of said thermosensitive temperature, said modular heat sink being particularly adapted and configured for use with a plurality of box sizes, said heat sink comprising:

(a) a plastic bottle having an external configuration matched to the configuration of selected boxes of said plurality of boxes said bottle having at least first and second planar walls;

(b) a recessed cavity formed within said bottle for receiving a thermosensitive portion of said thermolabile good, the remaining thickness of said bottle around said well being at least ⅜" in thickness;

(c) the external dimensions and configuration being selected so that one or more bottles may be inserted into and matched to one or more interior dimensions defined by said plurality of box sizes;

(d) said bottles being filled with a salt hydrate composition which will absorb heat from said high ambient temperatures and thereby protect said thermolabile goods, said composition including sodium sulfate decahydrate, a suspension agent and from 1 to 10% excess anhydrous sodium sulfate dispersed throughout said sodium sulfate decahydrate.

4. A modular heat sink as claimed in claim 1 or 3 wherein said plastic bottle is blow molded from high density polyethylene.

5. A modular heat sink as claimed in claims 1 or 3 which further includes means for spacing and maintaining a predetermined distance between said first and second walls.

6. A modular heat sink as claimed in claim 5 wherein said means for spacing is formed from one wall of said bottle.

7. A modular heat sink for protecting thermolabile goods having a thermosensitive temperature from high ambient temperatures in excess of said thermosensitive temperature, said modular heat sink being particularly adapted and configured for use with a plurality of box sizes, said heat sink comprising:

(a) a foldable plastic bottle having an elongated rectangular planar section;

(b) a V shaped notch formed on one planar side of the bottle for enabling said bottle to be folded about said notch to match the internal dimensions of selected boxes of said plurality of boxes;

(c) the rectangular dimensions and the placement of the notch being selected so that one or more panels may be formed with one or more bottles, and matched to one or more interior dimensions defined by said plurality of box sizes;

(d) said bottle being filled with a salt hydrate composition which will absorb heat from said high ambient temperatures and thereby protect said thermolabile goods, said salt hydrate composition including sodium sulfate decahydrate, a suspension agent and from 1 to 10% excess anhydrous sodium sulfate dispersed throughout said sodium sulfate decahydrated.

8. A modular heat sink as claimed in claim 3 or 7 wherein said suspension agent is fumed silicon dioxide.

9. A modular heat sink for protecting thermolabile goods having a thermosensitive temperature from high ambient temperatures in excess of said thermosensitive temperature, said modular heat sink being particularly adapted and configured for use with a plurality of box sizes, said heat sink comprising:

(a) a pair of plastic bottles having an external configuration matched to the configuration of selected boxes of said plurality of boxes;

(b) a recessed cavity formed within each bottle for receiving a thermosensitive portion of said thermolabile goods, the remaining thickness of said bottle around said well being at least ⅜" in thickness;

(c) the external dimensions and configuration being selected so that at least two bottles may be inserted into and matched to one or more interior dimensions defined by said plurality of box sizes, said pair of bottles being positioned with their respective cavities facing one another to create a protected zone for said thermolabile goods;

(d) said bottles being filled with a salt hydrate composition which will absorb heat from said high ambient temperatures and thereby protect said thermolabile goods.

10. A modular insulated shipping carton for protecting thermolabile goods having a thermosensitive temperature form high ambient temperatures in excess of said thermosensitive temperature, said shipping carton comprising:

(a) an external shipping carton, said carton being selected from one of a plurality of carton sizes;

(b) an internal heat sink, said heat sink including:

(i) at least one plastic bottle having an elongated rectangular planar cross section and at least first and second walls;

(ii) a V shaped notch formed on one side of the bottle in said first wall for enabling said bottle to be folded about said notch to match the internal dimension of selected boxes of said plurality of carton sizes said notch being greater than 90°;

(iii) the rectangular dimensions and the placement of the notch being selected so that one or more panels may be formed with one or more bottles, and matched to one or more interior dimensions defined by said plurality of box sizes;

(iv) said bottle being filled with a salt hydrate composition which will absorb heat from said high ambient temperatures and thereby protect said thermolabile goods;

(c) a layer of insulation between said heat sink and said external shipping carton, said insulation having a rate of heat transfer less than a rate of heat absorption of said heat sink.

11. A modular insulated shipping carton as claimed in claim 10 wherein said modular heat sink is secured by said insulation which is foamed-in-place.

12. A modular insulated shipping carton as claimed in claim 10 or 11 in which two modular heat sinks are folded about their respective notches and joined end to end to form a protective band around thermosensitive portion of said thermosensitive goods.

13. A modular insulated shipping carton as claimed in claim 10 or 11 in which four modular heat sinks are folded about their respective notches, with a first 2 of said bottles joined end to end to form a first band around the interior of the container, and a second 2 of said bottles joined end to end to form a second parallel band adjacent said first band.

14. A modular insulated shipping carton as claimed in claim 13 wherein said carton further includes an additional pair of modular heat sinks with one of said pair of heat sinks positioned at either opening end of said first and second parallel bands.

15. A modular insulated shipping carton as claimed in claim 10 or 11 in which four modular heat sinks are folded about their respective notches and joined end to end to form a pair of parallel bands, with at least one unfolded bottle positioned in center of said bands.

16. A modular insulated shipping carton as claimed in claim 15 in which a pair of unfolded bottles are positioned edge to edge within the center of said parallel bands to thereby define a pair of heat protected cavities.

17. A modular insulated shipping carton as claimed in claim 10 or 11 wherein said plastic bottle is blow molded from high density polyethylene.

18. A modular insulated shipping carton as claimed in claim 10 or 11 wherein said salt hydrate composition includes sodium sulfate decahydrate, a suspension agent and from 1 to 10% excess anhydrous sodium sulfate dispersed throughout said sodium sulfate decahydrate.

19. A modular insulated shipping carton as claimed in claim 18 wherein said suspension agent is fumed silicon dioxide.

20. A modular insulated shipping carton for protecting thermolabile goods having a thermosensitive temperature from high ambient temperatures in excess of said thermosensitive temperature, said shipping carton comprising:

(a) an external shipping carton, said carton being selected from one of a plurality of carton sizes;

(b) an internal heat sink, said heat sink including:

(i) a plurality of plastic bottles having an elongated rectangular planar cross section and at least first and second walls;

(ii) a V shaped notch formed on one side of the bottle in said first wall for enabling said bottle to be folded about said notch to match the internal dimension of selected boxes of said plurality of carton sizes, said notch being greater than 90°;

(iii) the rectangular dimensions and the placement of the notch being selected so that one or more panels may be formed with said plurality of battles when banded together in a tiled formation, said formation matching at least one of the interior dimensions defined by said plurality of box sizes;

(iv) each of said bottles being filled with a salt hydrate composition which will absorb heat from said high ambient temperatures and thereby protect said thermolabile goods;

(c) a layer of insulation between said heat sink and said external shipping carton, said insulation having a rate of heat transfer less than a rate of heat absorption of said heat sink.

21. A modular shipping system for protecting thermolabile goods having a thermosensitive temperature from high ambient temperatures in excess of said thermosensitive temperature, said shipping carton comprising:

(a) a plurality of external shipping cartons having a predetermined configuration each carton of said plurality being of a different size;

(b) an internal heat sink, said heat a sink having:

(i) a plastic bottle having at least one configuration which matches a configuration of each of the external shipping cartons;

(ii) a recessed cavity formed within said plastic bottle for surrounding a thermosensitive portion of said thermolabile goods;

(iii) the external dimension of said bottle and the internal dimensions of said plurality of shipping cartons being selected so that one or more bottles may be inserted into and match the internal dimensions of said plurality of external shipping cartons;

(iv) said bottle, being filled with a salt hydrate composition which will absorb heat form said high ambient temperatures and thereby protect said thermolabile goods;

(c) a layer of insulation, said layer of insulation surrounding at least the portion of the thermosensitive goods not protected by said recessed cavity formed within said heat sink.

22. A modular shipping carton as claimed in claim 21 wherein said insulation surrounds said heat sink and said thermolabile goods.

23. A modular shipping carton as claimed in claim 22 wherein said package further includes a pair of said heat sinks, with the recessed cavities of each heat sink facing one another.

24. A modular shipping carton as claimed in claim 23 wherein said heat sinks are secured in place by said insulation, said insulation being foamed-in-place.

25. A modular shipping carton as claimed in claim 24 wherein said insulation is polyurethane foam.

26. A modular shipping carton as claimed in claim 22 wherein said insulation is rigid polystyrene foam.

27. A modular shipping carton as claimed in claim 21 wherein said plastic bottle is blow molded from high density polyethylene.

28. A modular shipping carton as claimed in claim 21 wherein said salt hydrate composition includes sodium sulfate decahydrate, a suspension agent and from 1 to 10% excess anhydrous sodium sulfate dispersed throughout said sodium sulfate decahydrate.

29. A modular shipping carton as claimed in claim 28 wherein said suspension agent is fumed silicon dioxide.

30. A modular shipping carton as claimed in claim 21 wherein said insulation is bubble pack.

31. A modular shipping carton as claimed in claim 10 or 21 wherein said external shipping carton is corrugated cardboard.

* * * * *

UNITED STATES PATENT AND TRADEMARK OFFICE

CERTIFICATE OF CORRECTION

PATENT NO. : 4,923,077

DATED : May 8, 1990

INVENTOR(S) : Willem Van Iperen, et al.

It is certified that error appears in the above-identified patent and that said Letters Patent is hereby corrected as shown below:

In the Abstract, line 12: "wall" should read as --well--

Column 5, line 34: "Figures 1 and 4" should read as --Figures 1 and Figures 4--

Column 5, line 50: "to greater" should read as --to be slightly greater--

Column 10, line 4: "to sulfate." should read as --to form a slurry that is approximately 51% by weight of sodium sulfate.--

Column 10, line 5: delete "by weight of sodium"

Column 13, line 11, Claim 7: "planar section" should read as --planar cross section--

UNITED STATES PATENT AND TRADEMARK OFFICE

CERTIFICATE OF CORRECTION

PATENT NO. : 4,923,077

DATED : May 8, 1990

INVENTOR(S) : Willem Van Iperen, et al.

It is certified that error appears in the above-identified patent and that said Letters Patent is hereby corrected as shown below:

Column 14, line 8, Claim 10: "bottle" should read as --bottle(s)--

Column 15, line 7, Claim 20: "battles" should read as -- bottles--

Column 16, line 3, Claim 21: "bottle should read as --bottle(s)--

Signed and Sealed this

Fourth Day of June, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,923,077

DATED : May 8, 1990

INVENTOR(S) : Willem Van Iperen, et al.

It is certified that error appears in the above-identified patent and that said Letters Patent is hereby corrected as shown below:

Column 1, line 49: "sodium. sulfate" should read as --sodium sulfate--

Column 5, line 43: " $\frac{3}{8}$" " should read as -- $\frac{5}{8}$" --

Column 9, line 54: "279,879" should read as --297,879--

Signed and Sealed this

Sixth Day of April, 1993

*Attest:*

STEPHEN G. KUNIN

*Attesting Officer*

*Acting Commissioner of Patents and Trademarks*